United States Patent [19]

Casto

[11] 3,963,409

[45]*June 15, 1976

[54] CATALYTIC HEATING UNIT

[76] Inventor: William J. Casto, 319 N. Peachtree, Ponca City, Okla. 74601

[ * ] Notice: The portion of the term of this patent subsequent to Nov. 15, 1991, has been disclaimed.

[22] Filed: Apr. 16, 1973

[21] Appl. No.: 351,263

[52] U.S. Cl. ..... 431/28; 431/208; 431/260

[51] Int. Cl.[2] ..... F23N 5/22

[58] Field of Search ..... 431/260, 208, DIG. 10, 431/329, 11, 28

[56] References Cited

UNITED STATES PATENTS

| | | | |
|---|---|---|---|
| 2,490,095 | 12/1949 | Rosche | 431/28 |
| 2,551,823 | 5/1951 | Buttner et al. | 431/DIG. 10 |
| 2,642,130 | 6/1953 | Andersson et al. | 431/329 X |
| 2,657,744 | 11/1953 | Newton | 431/28 |
| 2,657,744 | 11/1953 | Newton | 431/DIG. 10 |
| 2,745,477 | 5/1956 | Welin-Berger | 431/28 |
| 3,253,641 | 5/1966 | Gutzeit | 431/28 X |
| 3,734,677 | 5/1973 | Murase | 431/208 X |

*Primary Examiner*—Edward G. Favors
*Attorney, Agent, or Firm*—William J. Miller

[57] ABSTRACT

A catalytic heater which has a fuel compartment and a catalytic burner element positioned on top of said fuel compartment and in communication therewith. A heating element is positioned between the catalytic heating element and the fuel compartment. A fuel source applies fuel into the compartment through a pump. A timer controls the time the pump is actuated, the amount of fuel transferred to the compartment, and the time the heating element is energized.

2 Claims, 3 Drawing Figures

CATALYTIC HEATING UNIT

BRIEF DESCRIPTION OF THE INVENTION

This invention describes a catalytic heating unit adaptable for portable use or permanent installation in an automobile. An automatic timer fills the unit with a predetermined quantity of fuel, ignites the catalytic element, and controls the burning time of the heating unit. Means are provided for either controlling the pumping time or the volume quantity of the fuel.

DETAILED DESCRIPTION OF THE INVENTION

Figure 1:
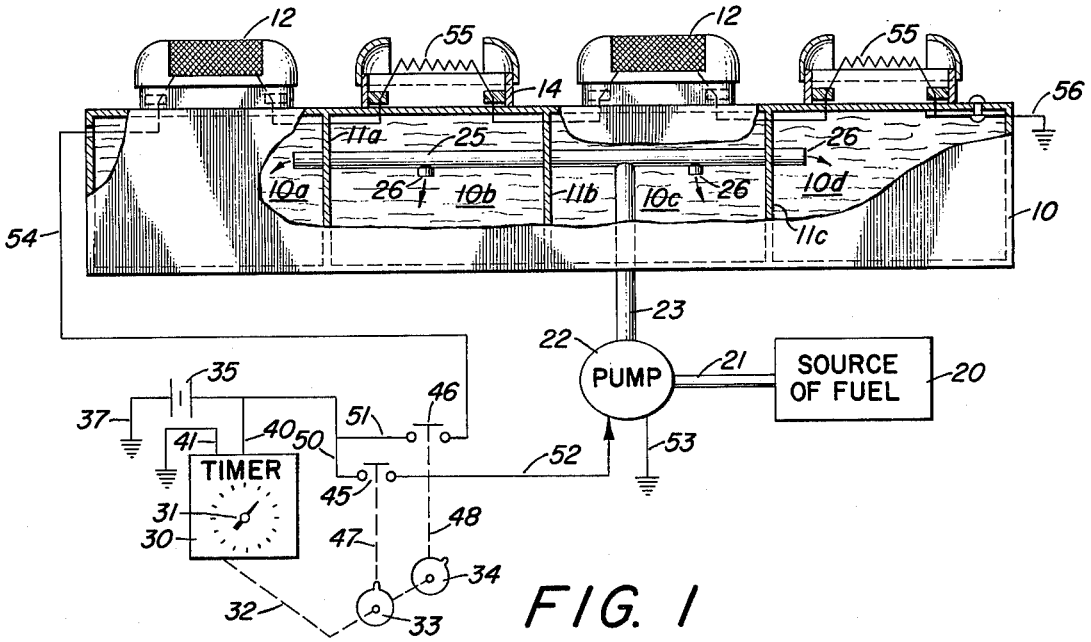
FIG. 1 is a partial cross-sectional and schematic drawing of the catalytic heater.

Referring to FIG. 1, a catalytic heating system is illustrated having a tank 10 comprising a plurality of compartments or smaller tanks 10*a*, 10*b*, 10*c*, and 10*d* formed by dividers 11*a*, 11*b*, and 11*c*. Each compartment, 10*a* for example, is filled with a material such as cotton. A catalytic burner element 12 is mounted to a cap 13 which in turn is affixed to a raised lip 14.

A source of fuel 20 is connected through a pipe 21 to a pump 22. Pipe 23 connects the pump to a distributor pipe 25 having outlets 26 into each of the tanks. A timer 30 has a clock (not shown) settable by a knob 31. A mechanical output is provided from timer 30 through a shaft 32 to a pair of cams 33 and 34. A battery 35 has one pole connected to ground through a wire 37 and the other pole connected to the timer through a wire 40. The wire 41 completes the electrical circuit for the timer. It is understood, of course, that the timer could be mechanical rather than electrical. A pair of relays 45 and 46 are mechanically operated through means 47 and 48, respectively, by cams 33 and 34, respectively. One pole of relays 45 and 46 is connected through wires 50 and 51 to battery 35. The remaining pole relay 45 is connected through wire 52 to pump 22. Wire 53 completes the pump circuit. The remaining pole of relay 46 is connected through a wire 54 to heating elements 55 which are connected in series. Wire 56 completes the heater circuit.

Figure 3:
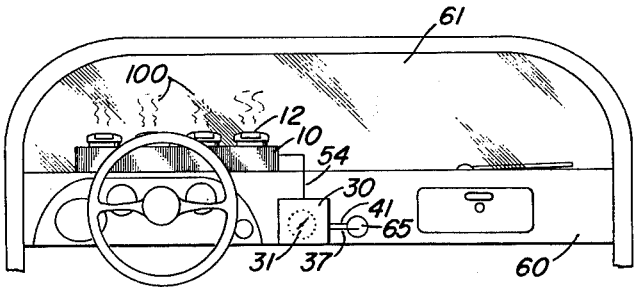
FIG. 3 is an illustration of a unit operating in an automobile.

Referring to FIG. 3 an installation in an automobile is illustrated. An automobile dashboard 60 has a windshield 61 mounted in front of same in the usual manner. Tank 10 is set on dashboard 60, if the system is portable, or may be mounted inside the dash (not shown), if a permanent installation is desired. Timer 30 can be built into the dash or attached by brackets thereto. The power from the timer 30 can be plugged into a cigarette lighter 65 or permanently installed.

Operation

Referring to FIGS. 1 and 3 the operation of the catalytic heating unit shall be described. The source of fuel 20, such as gasoline or naphtha, is pumped through pipe 21 by pump 22 and through pipe 23 to distributor 25 where the fuel will flow out of outlets 26 into each of the cotton-filled compartments 10*a* through 10*d*. In order to provide just enough fuel for a prescribed period of time, timer 30 is set for the burning time desired. The timer will then operate mechanical shaft 32 turning cam 33 causing mechanical means 47 to close contacts 45. Power will then be applied through wires 51 and 52 from battery 35 to pump 22. Pump 22 will operate for a prescribed time pumping a measured amount of fuel into the tank 10. After a prescribed period cam 33 will rotate, causing means 47 to open contacts 45 and deenergizing the pump. Cam 34 will also rotate, causing mechanical means 48 to close contacts 46. Electricity will then be connected from battery 35 through wires 51 and 54 to the heating elements 55 through wire 56 to the return circuit for battery 35. The heat from the elements 55 vaporizes the fuel and warms the platinum element 12, causing the initiation of the catalytic action. The heat 100 (see FIG. 3) will warm the windshield of the car, for example, defrosting or deicing same. After a prescribed period of time, sufficient to initiate the catalytic action, timer 30 will rotate cam 34 reopening contacts 46 disconnecting the heater elements 12 from the battery. The catalytic action will then continue until all the fuel is exhausted.

From the above it is obvious that the tank 10 and assembly including timer 30 can be made portable as illustrated or built-in. Timer 30 can be set to initiate the action at any time of the day, in the morning or evening or before or after work, for example. The time of operation can be set by the amount of fuel pumped into the tank 10*a* through 10*d*. The time can also be made a function of the temperature by shutting contacts 45 by a holding circuit which will hold the contacts closed longer in time as a function of the temperature, thereby pumping more fuel into the tanks 10.

In the portable version, power can easily be obtained by plugging the wires 41 and 37 into cigarette lighter 65. The fuel can be supplied by a separate fuel tank attached to the main tank 10.

Modified Embodiment

Figure 2:
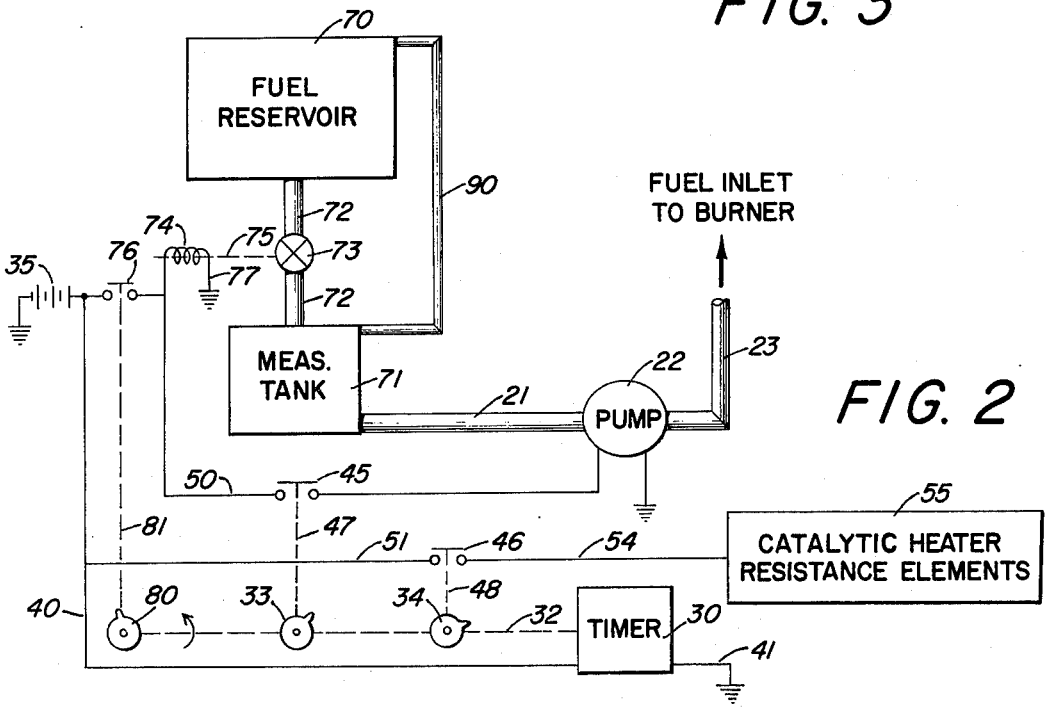
FIG. 2 is a partial cross-sectional and schematic drawing of an improved fuel measuring system.

A modified embodiment of the fuel supply system is illustrated in FIG. 2 wherein the source of fuel comprises a fuel reservoir 70. A measuring tank 71 is connected to tank 70 by pipe 72 through a valve 73 which is normally closed. A solenoid 74 through a mechanical linkage 75 can open valve 73. Electrical energy is supplied by battery 35 through a relay 76 to the solenoid 74. Wire 77 completes the circuit to ground. An additional cam 80 is connected mechanically through 81 to operate relay 76. Each of the relays 76, 45 and 46 are normally open and are closed by the cam pawl striking the mechanical connector means 81, 47 or 48, respectively. A pipe 90 permits air to escape from tank 71 to tank 70 when tank 71 is filling or emptying.

Operation

The operation of the embodiment illustrated in FIG. 2 is identical to that described in FIGS. 1 and 3 except for the fuel supply system. Fuel reservoir 70 can gravity feed fuel to tank 71 which is dimensional to contain a measured amount of fuel, for example, a one-hour burn of the heaters. Timer 30 rotates mechanical shaft 32 causing cam 80 to close, through linkage 81, contacts 76. Battery 35 supplies electrical power to solenoid coil 74 operating mechanical linkage 75 opening valve 73. Fuel will then pass from tank 70 through pipe 72 and to measured tank 71, filling same. Vent tube 90 permits air in tank 71 to pass to reservoir 70 prohibiting pollution and preventing overflow of the tank. When tank 71 is full, a prescribed interval of time later, cam 80 will open contact 76 releasing solenoid 74 and closing valve 73. Cam 33 will then close contaq s 45 pumping the fuel from tank 71 and pipe 23 and to distributor 25 (see FIG. 1). The cam 33 will then open contacts 45, and cam 34 will close contacts 46 to heat the elements 55 as previously described in the description of FIGS. 1 and 3.

Conclusion

A safe and efficient system has been described for heating a surface and/or the windshield of an automobile. It is obvious that modifications and improvements can be made and still be within the spirit and scope of this invention as described in the specification and appended claims.

What I claim is:

1. A catalytic heater comprising fluid compartment means, catalytic burner element means positioned over said fluid compartment means and in communication therewith, a heating element means positioned between said burner element means and said fluid compartment means, a supply of fuel, means for communicating said fuel to said fluid compartment means, pump means having an input connected to said fuel communication means, means for controlling the fuel flow through said pump including a timer, a first means controlled by said timer for operating said pump for a predetermined period of time, a power means and a second means for operation said power means for a predetermined interval of time, whereby said power means will energize said heating element means thereby initiating said catalytic action.

2. A device as described in claim 1 wherein said supply of fuel comprises a first and second tank, controlled valve means, means for connecting said first tank through said controlled valve to said second tank and wherein said pump means input is connected to said source of fuel through said second tank and wherein said timer includes means for selectively operating said controlled valve means.

* * * * *